US011805351B2

(12) United States Patent
Huang

(10) Patent No.: US 11,805,351 B2
(45) Date of Patent: Oct. 31, 2023

(54) EARTIP

(71) Applicant: Ji Cheng International Ltd., Hong Kong (HK)

(72) Inventor: Cheng Houng Huang, Taipei (TW)

(73) Assignee: Spinfit Trading Limited, Hong Kong (HK)

( * ) Notice: Subject to any disclaimer, the term of this patent is extended or adjusted under 35 U.S.C. 154(b) by 79 days.

(21) Appl. No.: 17/666,582

(22) Filed: Feb. 8, 2022

(65) Prior Publication Data

US 2022/0256270 A1 Aug. 11, 2022

(30) Foreign Application Priority Data

Feb. 9, 2021 (TW) ..... 110105096

(51) Int. Cl.
*H04R 1/10* (2006.01)

(52) U.S. Cl.
CPC ..... *H04R 1/1016* (2013.01); *H04R 1/1058* (2013.01)

(58) Field of Classification Search
CPC .. H04R 1/1016; H04R 25/652; H04R 25/656; H04R 25/658; H04R 2225/77
See application file for complete search history.

(56) References Cited

U.S. PATENT DOCUMENTS 5,396,563 A * 3/1995 Yoshimi ..... H04R 1/1016 381/372
7,480,387 B2 * 1/2009 Meyer ..... H04R 25/658 381/328
8,311,253 B2 * 11/2012 Silvestri ..... H04R 1/1075 381/381
8,897,458 B2 * 11/2014 Parkins ..... H04R 25/652 381/72
10,178,460 B2 * 1/2019 Jou ..... H04R 1/1058
10,291,980 B2 * 5/2019 Silvestri ..... H04R 1/2849
10,701,471 B1 * 6/2020 Hanson ..... C09K 5/063
10,820,084 B2 * 10/2020 Zalisk ..... H04R 1/1016
10,911,858 B2 * 2/2021 O'Callaghan ..... H04R 1/1083
10,999,670 B2 * 5/2021 Zalisk ..... H04R 1/1016
11,095,973 B1 * 8/2021 Zalisk ..... G10K 11/175
11,140,498 B2 * 10/2021 Barrett ..... H04R 25/652
(Continued)

FOREIGN PATENT DOCUMENTS

GB 2537353 A * 10/2016 ..... H04R 1/1016
WO WO-2010096032 A1 * 8/2010 ..... H04R 25/652
(Continued)

*Primary Examiner* — Ryan Robinson
(74) *Attorney, Agent, or Firm* — Minder Law Group; Willy H. Wong

(57) ABSTRACT

An eartip comprises a central tube part and a cone, the central tube part is in the shape of a column, the cone wraps around the central tube part, the cone comprises a first portion and a second portion, the first portion has a first hardness, the second portion has a second hardness less than the first hardness, a first upper end of the first portion is connected to a top end of the central tube part, and a bottom end of the first portion overlaps with a second upper end of the second portion to form a transition. The invention aims to solve the problems in the prior art that a hardness of eartip materials is too hard to cause discomfort to users, and too soft that may cause the structure to collapse.

8 Claims, 3 Drawing Sheets

(56) References Cited

U.S. PATENT DOCUMENTS

| | | | | |
|---|---|---|---|---|
| 11,159,899 | B2 * | 10/2021 | Jeong | H04R 25/654 |
| 11,582,549 | B2 * | 2/2023 | Zalisk | H04R 25/652 |
| 2012/0224734 | A1 * | 9/2012 | Cohen | H04R 25/652<br>427/256 |
| 2018/0071966 | A1 * | 3/2018 | Huang | H04R 31/00 |
| 2019/0166438 | A1 * | 5/2019 | Perkins | H04R 25/658 |
| 2019/0208302 | A1 * | 7/2019 | Monti | H04R 25/656 |
| 2022/0232308 | A1 * | 7/2022 | O'Callaghan | H04R 1/1058 |
| 2023/0164472 | A1 * | 5/2023 | Keady | H04R 1/1016<br>381/380 |

FOREIGN PATENT DOCUMENTS

| | | | |
|---|---|---|---|
| WO | WO-2022154344 | A1 * | 7/2022 |
| WO | WO-2023016645 | A1 * | 2/2023 |

* cited by examiner

EARTIP

RELATED APPLICATIONS

This application claims priority to Taiwan Patent Application No. 110105096 filed Feb. 9, 2021.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The invention relates to an eartip, and more particularly to an eartip with a varying softness.

Related Art

Eartip usually refers to the cover that covers the front end of an earphone. An object of the design is to improve the wearing comfort of users, and the eartip can further absorb external noise and enhance the user's listening experience. Eartip is usually made of soft materials, such as silicone. However, in order to connect with an earphone, a certain degree of hardness must still be maintained. Such hardness may cause a certain degree of discomfort to the user, especially for people with curved, narrow ear canals. However, if a softer material is used, it may not be able to maintain the structure of the eartip and the structure may collapse, and if the overall structure of the eartip is too soft, it may make the user feel that it is easy to fall out and feel insecure.

SUMMARY OF THE INVENTION

Therefore, in order to solve various problems of the conventional eartips, one embodiment of the invention provides an eartip with a varying softness.

In order to achieve the above-mentioned object and other objects, the invention provides one embodiment of an eartip comprising: a central tube part in the shape of a column; and a cone wrapping around the central tube part, the cone comprises a first portion and a second portion, the first portion has a first hardness, the second portion has a second hardness less than the first hardness, a first upper end of the first portion is connected to a top end of the central tube part, and a bottom end of the first portion overlaps with a second upper end of the second portion to form a transition.

In one embodiment of the invention, in the transition, a thickness of the first portion gradually decreases from top to bottom, and a thickness of the second portion gradually increases from top to bottom.

In one embodiment of the invention, a connecting surface between the bottom end of the first portion and the second upper end of the second portion is a bevel.

In one embodiment of the invention, in the transition, the bottom end of the first portion is located on an outer side of the second upper end of the second portion.

In one embodiment of the invention, in the transition, the bottom end of the first portion is located on an inner side of the second upper end of the second portion.

In one embodiment of the invention, a length of the transition is 2 to 3 times a thickness of the cone.

In one embodiment of the invention, the bottom end of the first portion is connected to the second upper end of the second portion.

In one embodiment of the invention, an inner side of the second portion is provided with a reinforcement protruding from a surface.

The invention further provides an eartip comprising: a central tube part in the shape of a column; and a cone wrapping around the central tube part, an upper portion of the cone has a first hardness, a lower portion of the cone has a second hardness less than the first hardness, a transition is disposed between the upper portion and the lower portion of the cone, and a hardness of the transition is between the first hardness and the second hardness.

In one embodiment of the invention, the hardness of the transition changes gradually.

Thereby, the eartip of the invention overcomes many problems of the prior art, not only capable of maintaining a strength of the eartip, but also making a user feel secure when wearing the eartip, and the softer second portion attached to an ear canal wall is capable of enhancing a degree of comfort for the user.

DETAILED DESCRIPTION OF THE INVENTION

In order to fully understand the invention, the invention is described in detail by the following specific embodiments in conjunction with the accompanying drawings. A person having ordinary skill in the art to which the invention pertains can understand the objects, features and efficacies of the invention from the contents disclosed in this specification. It should be noted that the invention can be implemented or applied through other different specific embodiments, and various details in this specification can also be modified and changed based on different viewpoints and applications without departing from the spirit of the invention. The following embodiments will further describe the related technical contents of the invention in detail, but the disclosed content is not intended to limit the scope of protection of the invention as set forth in the claims.

Figure 1:
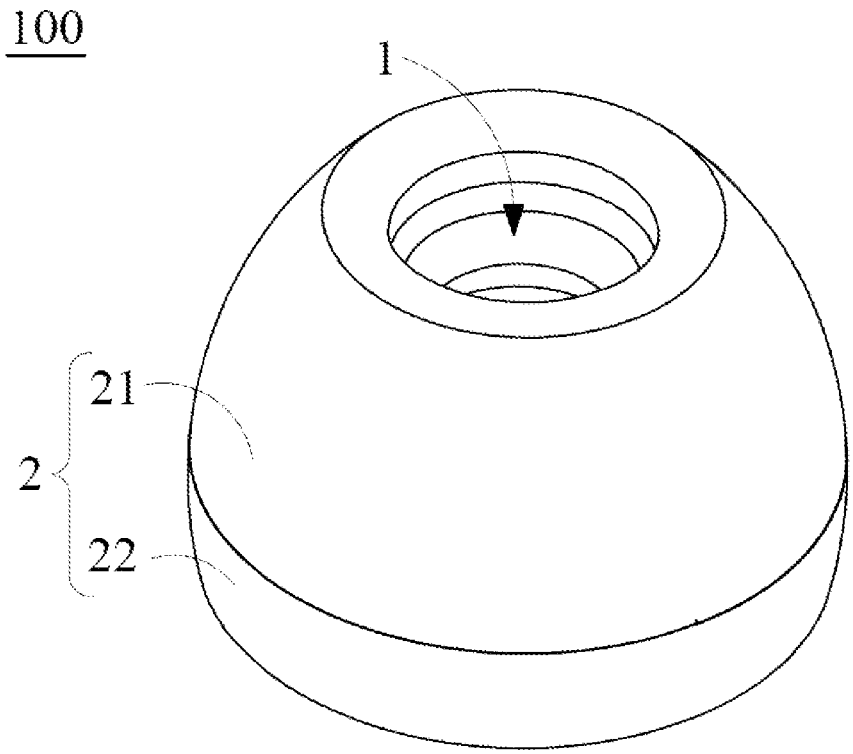
FIG. 1 is a perspective view of an eartip according to a first embodiment of the invention.

As shown in FIG. 1, an eartip 100 according to one embodiment of the invention comprises a central tube part 1 and a cone 2.

Figure 2:
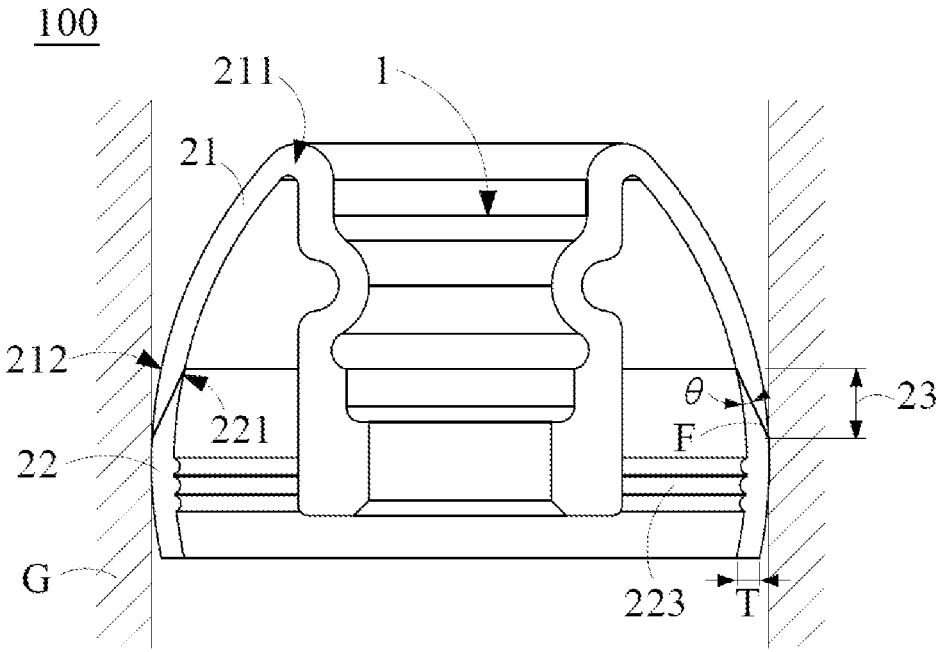
FIG. 2 is a cross-sectional view of the eartip according to the first embodiment of the invention.

As shown in FIG. 2, one embodiment of the central tube part 1 has a columnar shape. In this embodiment, the central tube part 1 is a cylinder, but the central tube part 1 can also be a square column, a polygonal column or a column of other shapes. The central tube part 1 serves as a support structure for the eartip 100, and can be hollow to be sleeved on an earphone (not shown in the figures), or a connecting part of other shapes and structures to be matched and connected to an earphone. In other embodiments, the central tube part 1 can also be solid, and can be used as an independent eartip.

One embodiment of the cone 2 wraps around the central tube part 1. The cone 2 comprises a first portion 21 and a second portion 22. The first portion 21 has a first hardness, and the second portion 22 has a second hardness less than the first hardness. In this embodiment, the first portion 21 and the second portion 22 are respectively silicone rubber with two different hardnesses, but the invention is not limited thereto, other suitable materials can also be used. In this embodiment, the hardness of the first portion 21 is 40 Shore hardness degrees, the hardness of the second portion 22 is 20 Shore hardness degrees, 40 Shore hardness degrees is capable of maintaining a structure of the eartip 100, and a softness of 20 Shore hardness degrees is sufficiently capable of attaching against the skin flatly and making a user feel almost like not wearing anything. However, the invention is not limited thereto, a hardness of the material used can be appropriately changed.

A first upper end 211 of one embodiment of the first portion 21 is connected to a top end of the central tube part 1, and a bottom end 212 of the first portion 21 overlaps with a second upper end 221 of the second portion 22 to form a transition 23.

On the premise that a thickness T of one embodiment of the cone 2 remains unchanged, the transition 23 has both the first portion 21 and the second portion 22, so a hardness of the transition 23 is balanced by the first hardness and the second hardness, and an actual hardness of the transition 23 is between the first hardness and the second hardness.

A disposing position of one embodiment of the transition 23 just matches an ear canal wall G of the human ear, so that the transition 23 is capable of abutting against the ear canal wall G with a moderate hardness and a small contact area, the human ear will not feel uncomfortable with an excessive hardness, and the hardness of the first portion 21 that is not in direct contact with the human ear is still retained in order to maintain the structural integrity of the eartip 100. In addition, the hardness of the transition 23 is between the first hardness and the second hardness, providing the user with a certain degree of tactile impression on a small contact area, making the user feel secure in wearing, and the remaining second portion 22 is attached on the ear canal wall G to enhance a degree of comfort for the user.

In summary, one embodiment of the eartip 100 of the invention is capable of overcoming many problems of the prior art by maintaining a strength of the eartip 100, enhancing a degree of comfort for the user, and making the user feel secure when wearing the eartip 100.

Further, as shown in FIG. 2, in this embodiment, in the transition 23, a thickness of the first portion 21 gradually decreases from top to bottom, and a thickness of the second portion 22 gradually increases from top to bottom. In other words, a proportion of the first portion 21 is gradually decreased, and a proportion of the second portion 22 is gradually increased, so that the hardness of the transition 23 changes gradually.

In this embodiment, a connecting surface between the bottom end 212 of the first portion 21 and the second upper end 221 of the second portion 22 is a bevel F with a tilt angle A, and the tilt angle A is preferably 15 degrees to 40 degrees, more preferably 20 degrees to 25 degrees.

In this embodiment, a length of the transition 23 is 2 to 3 times the thickness T of the cone 2. Preferably, the thickness T of the cone 2 is between 0.4 mm and 0.45 mm, and the length of the transition 23 is 1 mm.

Figure 3:
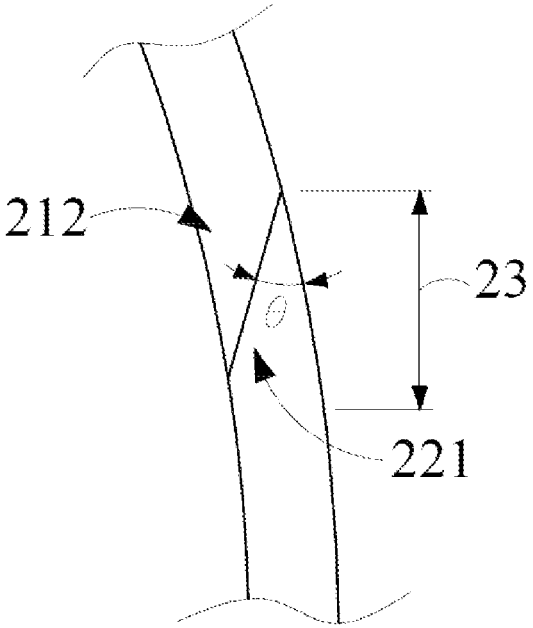
FIG. 3 is a partial cross-sectional view of a cone according to a second embodiment of the invention.

In this embodiment, in the transition 23, the bottom end 212 of the first portion 21 is located on an outer side of the second upper end 221 of the second portion 22. However, the invention is not limited thereto, as shown in FIG. 3, in a second embodiment, in the transition 23, the bottom end 212 of the first portion 21 is located on an inner side of the second upper end 221 of the second portion 22. Both methods are capable of making the hardness of the transition 23 change gradually, but the invention is not limited thereto.

Figure 4:
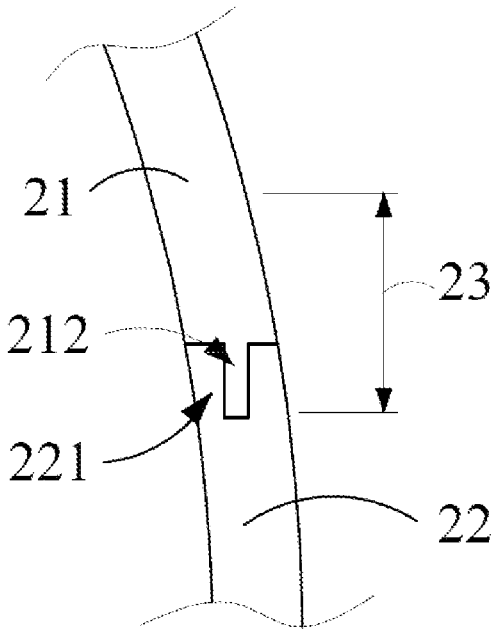
FIG. 4 is a partial cross-sectional view of the cone according to a third embodiment of the invention.

The cone 2 of a third embodiment of the invention can also be modified as shown in FIG. 4: the bottom end 212 of the first portion 21 is connected to the second upper end 221 of the second portion 22. In other words, a form of overlapping between the bottom end 212 of the first portion 21 and the second upper end 221 of the second portion 22 of the invention is not limited to overlapping at the bevel F obliquely, and can also be other overlapping structures and forms.

Further, in a first embodiment of the invention, as shown in FIG. 2, an inner side of the second portion 22 is provided with a reinforcement 223 protruding from a surface. The reinforcement 223 can be, for example, in a form of three rings as depicted in the figure, or more than three rings (for example, five rings), or crossed ribs, arranged convex dots, etc. The reinforcement 223 is capable of preventing the second portion 22 with a relatively soft hardness from shrinking, and maintaining the second portion 22 in a band-like form to be connected to the bottom end 212 of the first portion 21.

Figure 5:
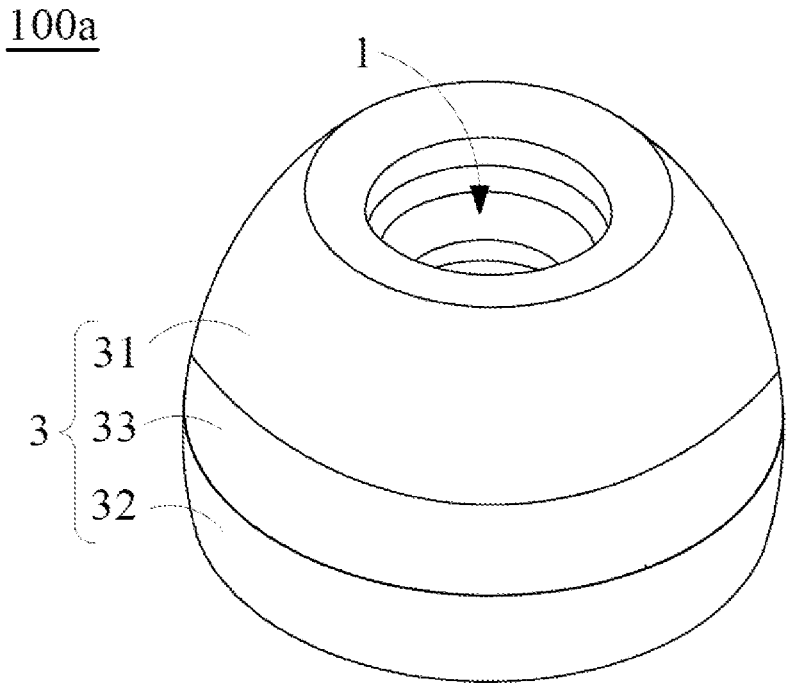
FIG. 5 is a perspective view of the eartip according to a fourth embodiment of the invention.

As shown in FIG. 5, the invention further provides a fourth embodiment. An eartip **100*a* of the fourth embodiment comprises the central tube part 1 and a cone 3. The central tube part 1 is the same as the central tube part 1** of the first embodiment, so it will not be repeated.

The cone 3 wraps around the central tube part 1, an upper portion 31 of the cone 3 has a first hardness, a lower portion 32 of the cone 3 has a second hardness less than the first hardness, a transition 33 is disposed between the upper portion 31 and the lower portion 32 of the cone 3, and a hardness of the transition 33 is between the first hardness and the second hardness. The hardness of the transition 33 can be achieved by the aforementioned structural method to be between the first hardness and the second hardness, or the transition 33 can be made of a material with a hardness between the first hardness and the second hardness. The hardness of the transition 33 can be continuously and gradually changed, or can be changed stepwise, or is not changed.

For example, the hardness of one embodiment of the transition 33 can be continuously and gradually decreased from Shore hardness degrees of 39, 38, 37 from top all the way to nearly 20 degrees; or the transition 33 can be further divided into several bands with different hardnesses of 35 degrees, 30 degrees, and 25 degrees from top to bottom; or the hardness of the transition 33 itself is 30 degrees.

One embodiment of the eartip **100*a* of the invention is also capable of achieving the same efficacies: maintaining a strength of the eartip 100*a*, enhancing a degree of comfort for the user, and making the user feel secure when wearing the eartip 100*a***.

The specific embodiments described herein are merely illustrative of the spirit of the invention. Technicians skilled in the art to which the invention pertains can make various modifications or additions to the specific embodiments described or replace them in a similar manner, without departing from the spirit of the invention or beyond the scope defined by the appended claims.

LIST OF REFERENCED PARTS

100 eartip
100*a* eartip
1 central tube part
2 cone
21 first portion
211 first upper end
212 bottom end
22 second portion
221 second upper end
223 reinforcement
23 transition
3 cone
31 upper portion
32 lower portion
33 transition
F bevel
G ear canal wall
T thickness
θ tilt angle

What is claimed is:

1. An eartip comprising:

a central tube part in a shape of a column; and a cone wrapping around the central tube part, the cone comprising a first portion and a second portion, the first portion having a first hardness, the second portion having a second hardness less than the first hardness, a first upper end of the first portion being connected to a top end of the central tube part, a bottom end of the first portion overlapping with a second upper end of the second portion to form a transition;

wherein in the transition, a thickness of the first portion gradually decreases from top to bottom, a thickness of the second portion gradually increases from top to bottom, and a length of the transition is 2 to 3 times a thickness of the cone.

2. The eartip as claimed in claim 1, wherein a connecting surface between the bottom end of the first portion and the second upper end of the second portion is a bevel.

3. The eartip as claimed in claim 1, wherein in the transition, the bottom end of the first portion is located on an outer side of the second upper end of the second portion.

4. The eartip as claimed in claim 1, wherein in the transition, the bottom end of the first portion is located on an inner side of the second upper end of the second portion.

5. The eartip as claimed in claim 1, wherein the bottom end of the first portion is connected to the second upper end of the second portion.

6. The eartip as claimed in claim 1, wherein an inner side of the second portion is provided with a reinforcement protruding from an inner surface of the second portion.

7. An eartip comprising:

a central tube part in the shape of a column; and a cone wrapping around the central tube part, an upper portion of the cone having a first hardness, a lower portion of the cone having a second hardness less than the first hardness, a transition being disposed between the upper portion and the lower portion of the cone, a hardness of the transition being between the first hardness and the second hardness;

wherein the cone comprises a first portion and a second portion, the first portion is the upper portion and has the first hardness, the second portion is the lower portion and has the second hardness, in the transition, a thickness of the first portion gradually decreases from top to bottom, a thickness of the second portion gradually increases from top to bottom, and a length of the transition is 2 to 3 times a thickness of the cone.

8. The eartip as claimed in claim 7, wherein the hardness of the transition changes gradually.

* * * * *